US011802482B2

(12) United States Patent
Kilchyk

(10) Patent No.: US 11,802,482 B2
(45) Date of Patent: Oct. 31, 2023

(54) ROTOR WITH INLETS TO CHANNELS

(71) Applicant: Hamilton Sundstrand Corporation, Charlotte, NC (US)

(72) Inventor: Viktor Kilchyk, Lancaster, NY (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/587,847

(22) Filed: Jan. 28, 2022

(65) Prior Publication Data

US 2023/0243262 A1 Aug. 3, 2023

(51) Int. Cl.
*F04D 27/02* (2006.01)
*F01D 5/02* (2006.01)
*F01D 25/24* (2006.01)

(52) U.S. Cl.
CPC ..... *F01D 5/02* (2013.01); *F01D 25/24* (2013.01)

(58) Field of Classification Search
CPC . F01D 5/02; F01D 25/04; F01D 5/146; F01D 5/303; F01D 5/3038; F01D 5/147; F01D 25/125
USPC ..... 415/58.5; 416/231, 232
See application file for complete search history.

(56) References Cited

U.S. PATENT DOCUMENTS 3,749,520 A * 7/1973 Bandukwalla ..... F04D 29/682 415/218.1
4,183,719 A * 1/1980 Bozung ..... F04D 29/285 415/143
4,472,107 A * 9/1984 Chang ..... F04D 29/0513 415/170.1
4,479,755 A 10/1984 Skoe
6,210,104 B1 4/2001 Schonenborn
8,246,296 B2 * 8/2012 Smith ..... F01D 5/145 415/115
10,260,355 B2 4/2019 Smoke et al.
2010/0034634 A1 2/2010 Scarinci et al.
2010/0202870 A1 * 8/2010 Oklejas, Jr. ..... F04D 29/2266 415/111
2013/0098061 A1 * 4/2013 Matwey ..... F04D 29/285 60/785
2020/0300115 A1 9/2020 Aurahs et al.
2021/0123380 A1 4/2021 Yokoyama et al.
2021/0324870 A1 10/2021 Greenfield et al.
2022/0010682 A1 1/2022 Gluck et al.

FOREIGN PATENT DOCUMENTS

DE 102014009735 A1 * 1/2016 ..... B22F 10/28
DE 102014009735 A1 1/2016
EP 3719257 A1 10/2020
GB 937987 A 9/1963

OTHER PUBLICATIONS

Extended European Search Report for European Patent Application No. 23151372.2, dated Jul. 4, 2023, 7 pages.

* cited by examiner

*Primary Examiner* — Hung Q Nguyen
*Assistant Examiner* — Anthony Donald Taylor, Jr.
(74) *Attorney, Agent, or Firm* — Kinney & Lange, P.A.

(57) ABSTRACT

A rotor includes a blade, a hub connected to a radially inner edge of the blade, an outlet, and a channel. The blade includes a first side between a leading edge and a trailing edge and a first channel inlet in the first side of the blade. The outlet is in a radially inner surface of the hub. The channel is between the first channel inlet and the outlet.

10 Claims, 9 Drawing Sheets

ROTOR WITH INLETS TO CHANNELS

BACKGROUND

This invention relates to rotary machine rotor blades and, more specifically, inlets in turbine rotor blades to channels within turbine rotors.

Rotary machines like turbines have rotors, or impellers, which spin within the machine to create power using a working fluid. Blades on the rotor direct the working fluid as it moves through the rotor. Depending on inlet angle working fluid takes around leading edges of the blades, working fluid can separate and form a recirculation zone near the blades. Recirculation zones create flow blockages and can cause viscous losses near the blades. Working fluid separation and the resultant recirculation zones reduce the overall rotary machine.

Additive manufacturing can be used to create complex interior structures within a rotor. This includes voids, lattice structures, and cooling passages. Such passages have been used to cool the rotor.

SUMMARY

A rotor includes a blade, a hub connected to a radially inner edge of the blade, an outlet, and a channel. The blade includes a first side between a leading edge and a trailing edge and a first channel inlet in the first side of the blade. The outlet is in a radially inner surface of the hub. The channel is between the first channel inlet and the outlet.

A rotor includes a hub, a plurality of blades, outlets, and channels. Each of the blades include a radially inner edge and a first channel inlet. The radially inner edges are connected to the hub. The first channel inlets are in a first side of each blade and are positioned to capture working fluid recirculating near leading edges of the blades. The outlets are in a radially inner surface of the hub opposite where each blade connects to the hub. The channels are within the hub and remove the captured working fluid from the first channel inlets to the outlets.

A rotary machine includes a first inlet, a first outlet, a first duct, a first rotor, a first bearing, and a bearing cooling flow path. The first duct extends from the first inlet to the first outlet. The first rotor is in the duct. The first rotor includes a blade, a hub connected to a radially inner edge of the blade, an outlet, and a channel. The blade includes a first side between a leading edge and a trailing edge. The blade also includes a first channel inlet in the first side of the blade. The outlet is in a radially inner surface of the hub. The channel is between the first channel inlet and the outlet. The first bearing supports the rotor. The cooling flow path begins at the first channel inlet.

DETAILED DESCRIPTION

Figure 1:
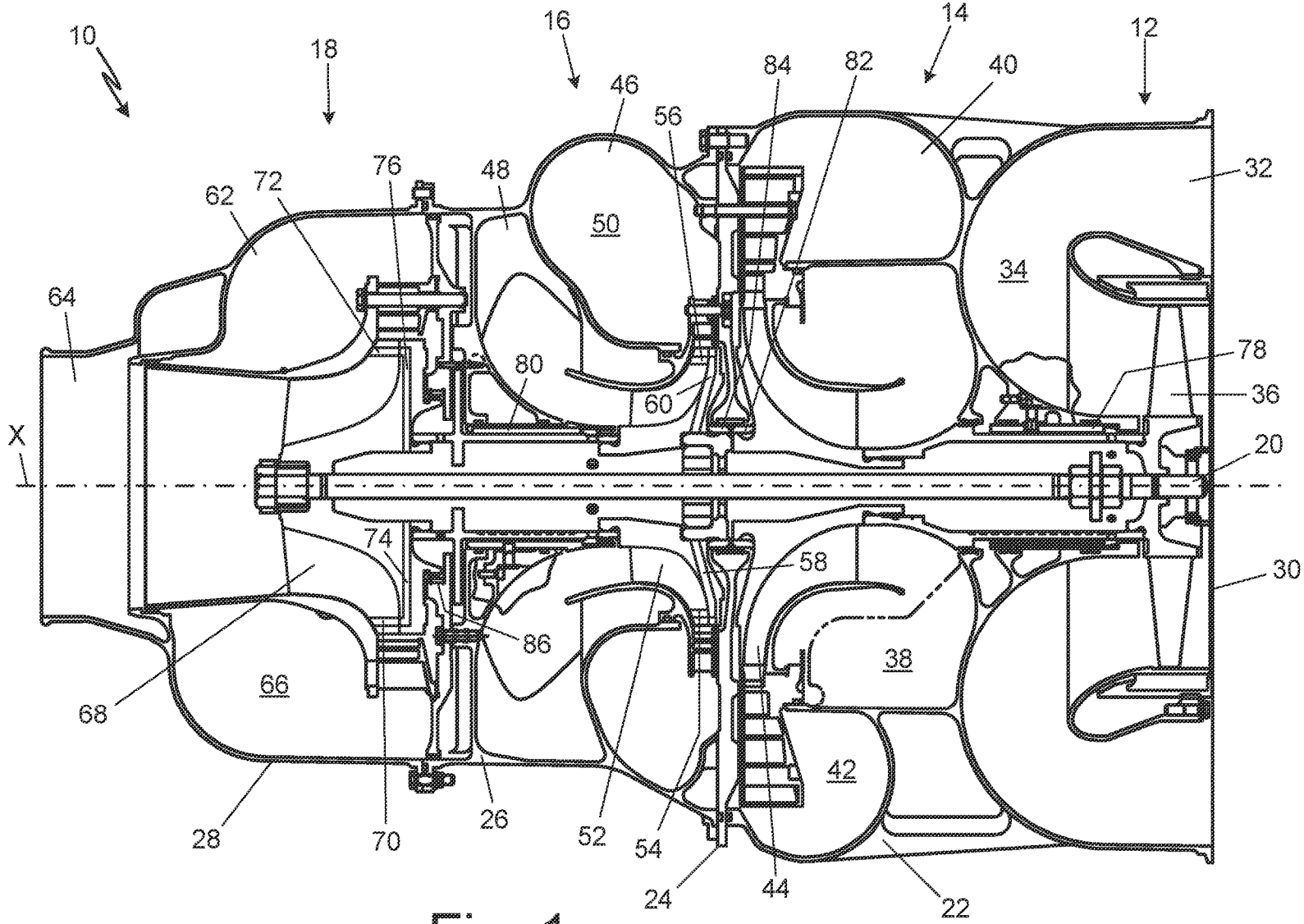
FIG. 1 is a cross-sectional view of an air cycle machine.

FIG. 1 is a cross-sectional view of air cycle machine 10, which includes fan section 12, compressor section 14, first turbine section 16, second turbine section 18, tie rod 20, fan and compressor housing 22, seal plate 24, first turbine housing 26, and second turbine housing 28. Fan section 12 includes fan inlet 30, fan outlet 32, fan duct 34, and fan rotor 36. Compressor section 14 includes compressor inlet 38, compressor outlet 40, compressor duct 42, and compressor rotor 44. First turbine section 16 includes first turbine inlet 46, first turbine outlet 48, first turbine duct 50, and first turbine rotor 52. First turbine rotor 52 also includes first channel inlet 54, second channel inlet 56, first channel 58, and second channel 60. Second turbine section 18 includes second turbine inlet 62, second turbine outlet 64, second turbine duct 66, and second turbine rotor 68. Second turbine rotor 68 includes third channel inlet 70, fourth channel inlet 72, third channel 74, and fourth channel 76. Air cycle machine 10 further includes first journal bearing 78, second journal bearing 80, compressor rotor bearing 82, first turbine rotor bearing 84, and second turbine rotor bearing 86. Also shown in FIG. 1 is axis X.

In air cycle machine 10, fan section 12, compressor section 14, first turbine section 16, and second turbine section 18 are all mounted on tie rod 20. Tie rod 20 rotates about axis X. Fan and compressor housing 22 is connected to seal plate 24 and first turbine housing 26 with fasteners. First turbine housing 26 is connected to second turbine housing 28 with fasteners. Fan and compressor housing 22, first turbine housing 26, and second turbine housing 28 together form an overall housing for air cycle machine 10. Fan and compressor housing 22 houses fan section 12 and compressor section 14. First turbine housing 26 houses first turbine section 16. Second turbine housing 28 houses second turbine section 18.

Fan section 12 includes fan inlet 30, fan outlet 32, fan duct 34, and fan rotor 36. Fan inlet 30 is connected to fan outlet 32 by fan duct 34. Fan rotor 36 is in fan duct 34 adjacent to fan inlet 30 and is mounted to and rotates with tie rod 20. Fan rotor 36 draws air into fan section 12 to be routed through air cycle machine 10. Fan section 12 draws in ram air from a ram air scoop or from another aircraft component like an associated gas turbine. The air drawn in enters a main flow path through air cycle machine 10. Air moves through fan duct 34 to fan outlet 32.

Compressor section 14 includes compressor inlet 38, compressor outlet 40, compressor duct 42, and compressor rotor 44. Compressor inlet 38 connects to compressor outlet 40 through compressor duct 42. Compressor rotor 44 is in compressor duct 42 and is mounted to and rotates with tie rod 20. Air follows the main flow path through compressor section 14 by entering compressor inlet 38. Compressor rotor 44 rotates and increases the velocity of the air. As the air moves through compressor duct 42 downstream of rotor 44, air velocity decreases and air pressure increases. Air exits compressor duct 42 through compressor outlet 40.

First turbine section 16 includes first turbine inlet 46, first turbine outlet 48, first turbine duct 50, and first turbine rotor 52. First turbine inlet 46 connects to first turbine outlet 48 through first turbine duct 50. First turbine rotor 52 is positioned in first turbine duct 50 and is mounted to and rotates tie rod 20. Air follows the main flow path into first turbine inlet 46 and is ducted through first turbine duct 50 to first turbine outlet 48. First turbine rotor 52 extracts energy from the air passing through first turbine section 16 following the main flow path. Extracted energy rotates tie rod 20. The air expands and cools following the main flow path through first turbine rotor 52.

First turbine rotor 52 includes first channel inlet 54, second channel inlet 56, first channel 58, and second channel 60. First channel inlet 54 is in a side of a first blade in first turbine rotor 52. Second channel inlet 56 is in a side of a second blade in first turbine rotor 52. First channel inlet 54 and second channel inlet 56 are near upstream portions of the first blade and the second blade, respectively. First channel 58 is within first turbine rotor 52 and fluidly connects first channel inlet 54 to an outlet in a hub of first turbine rotor 52. Second channel 60 is within first turbine rotor 52 and fluidly connects second channel inlet 56 to an outlet in the hub of first turbine rotor 52.

The main flow approaches first turbine rotor 52 with a certain inlet angle to the leading edges of the blades. An inlet angle is the angle between the blade and incoming air. Air must have a minimum inlet angle when entering first turbine rotor 52 to avoid separating. Air that is forced to turn less than the minimum inlet angle separates from the main flow. Separated flow moves through a secondary flow path including first channel inlet 54 and second channel inlet 56. Separated flow follows the secondary flow path through first channel 58 and second channel 60 into a middle portion of air cycle machine 10 near tie rod 20.

Second turbine section 18 includes second turbine inlet 62, second turbine outlet 64, second turbine duct 66, and second turbine rotor 68. Second turbine inlet 62 connects to second turbine outlet 64 through second turbine duct 66. Second turbine rotor 68 is positioned in second turbine duct 66 and is mounted to and rotates tie rod 20. Air follows the main flow path into second turbine inlet 62 and is ducted through second turbine duct 66 to second turbine outlet 64. Second turbine rotor 68 extracts energy from the air passing through second turbine section 18 and rotates tie rod 20. The air expands and cools moving through second turbine rotor 68.

Second turbine rotor 68 includes third channel inlet 70, fourth channel inlet 72, third channel 74, and fourth channel 76. Third channel inlet 70 is in a side of a first blade in second turbine rotor 68. Fourth channel inlet 72 is in a side of a second blade in second turbine rotor 68. Third channel inlet 70 and fourth channel inlet 72 are near upstream portions of the first blade and the second blade, respectively. Third channel 74 is within second turbine rotor 68 and connects third channel inlet 70 to an outlet in a hub of second turbine rotor 68. Fourth channel 76 is within second turbine rotor 68 and connects fourth channel inlet 72 to an outlet in the hub of second turbine rotor 68.

As discussed in relation to first turbine rotor 52, air forced around blades of second turbine rotor 68 at an inlet angle smaller than a minimum inlet angle separates from the main flow. Separated flow moves through the secondary flow path entering through third channel inlet 70 and fourth channel inlet 72. Separated flow follows the secondary flow path through third channel 74 and fourth channel 76 into a middle portion of air cycle machine 10 near tie rod 20.

Air cycle machine 10 further includes first journal bearing 78, second journal bearing 80, compressor rotor bearing 82, first turbine rotor bearing 84, and second turbine rotor bearing 86. First journal bearing 78 is positioned in fan section 12 and is supported by fan and compressor housing 22. A radially outer surface of a first rotating shaft abuts a radially inner surface of first journal bearing 78. Second journal bearing 80 is positioned in first turbine section 16 and is supported by first turbine housing 26. A radially outer surface of a second rotating shaft abuts a radially inner surface of second journal bearing 80. First journal bearing 78 and second journal bearing 80 support the first rotating shaft and the second rotating shaft, respectively.

Compressor rotor bearing 82, first turbine rotor bearing 84, and second rotor bearing 86 are journal bearings. Compressor rotor bearing 82 has a radially inner surface abutting compressor rotor 44 and a radially outer surface abutting seal plate 24. First turbine rotor bearing 84 has a radially inner surface abutting first turbine rotor 52 and a radially outer surface abutting seal plate 24. Second turbine rotor bearing 86 has a radially inner surface abutting second turbine rotor 68 and a radially outer surface abutting a portion of second turbine housing 28. Compressor rotor bearing 82 supports compressor rotor 44; first turbine rotor bearing 84 supports first turbine rotor 52; second turbine rotor bearing 86 supports second turbine rotor 68.

The secondary flow path is a bearing cooling flow path through air cycle machine 10. After following the secondary flow path through first turbine rotor 52 and second turbine rotor 68, the separated air cools first journal bearing 78, second journal bearing 80, compressor rotor bearing 82, first turbine rotor bearing 84 and second turbine rotor bearing 86. The secondary flow path ends at compressor inlet 38. Air used to cool bearings in air cycle machine 10 can then move through the main flow path again. Removed separated air can alternatively be used for other process needs within air cycle machine 10.

Removing separated air from first turbine rotor 52 and second turbine rotor 68 with first channel inlet 54, second channel inlet 56, third channel inlet 70, and fourth channel inlet 72, respectively, reduces the amount of separated air in first turbine rotor 52 and second turbine rotor 68. Separated air creates a recirculation zone that increases flow blockage and viscous loss between the air and the blades of a rotor. Removing separated air from first turbine rotor 52 and second turbine rotor 68 increases the overall efficiency of air cycle machine 10. Removed separated air provides a source of cooling air for first journal bearing 78, second journal bearing 80, compressor rotor bearing 82, first turbine rotor bearing 84, and second turbine rotor bearing 86.

Figure 2A:
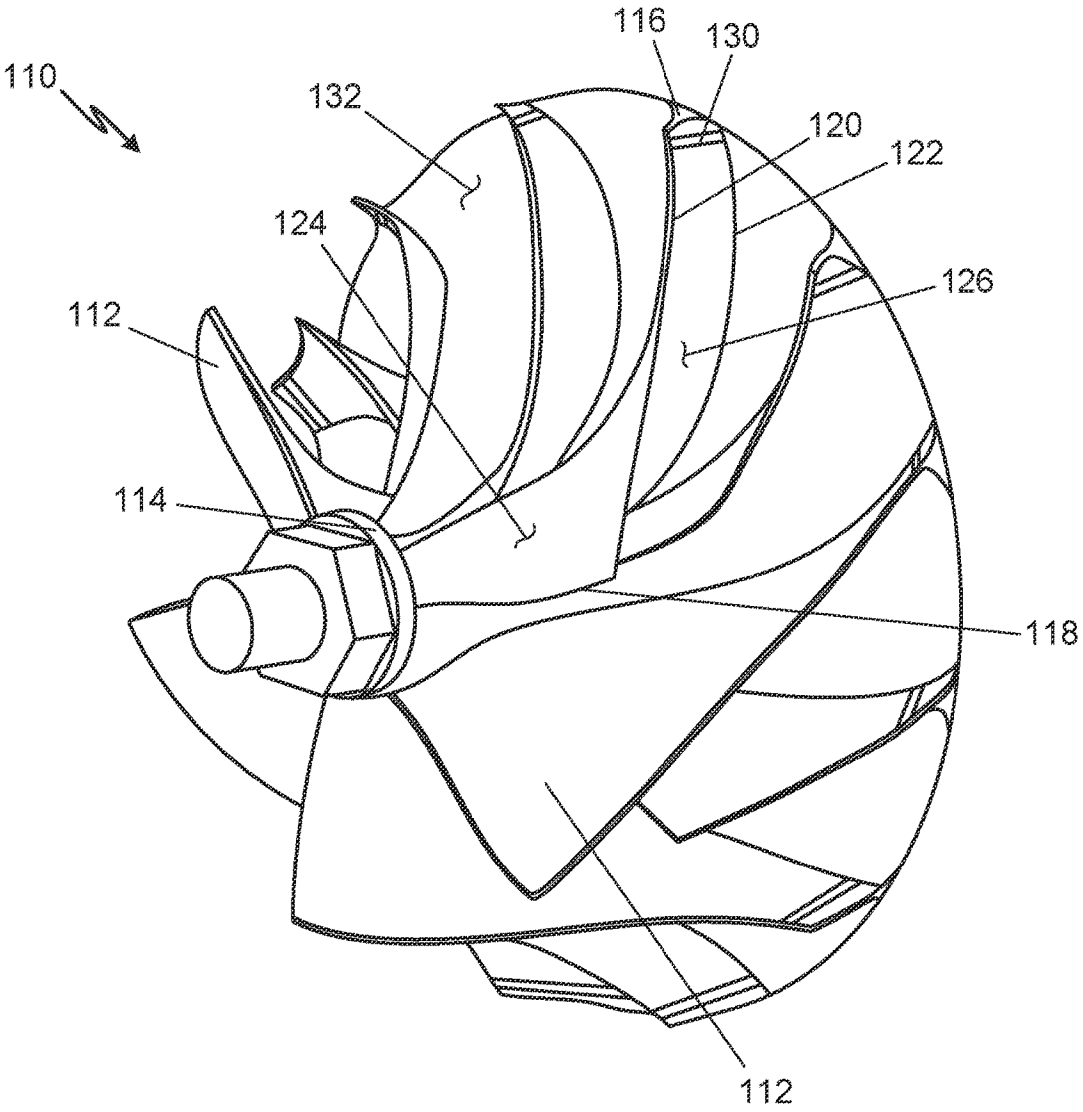
FIG. 2A is a perspective view of a rotor with blades and channel inlets in the blades.
Figure 2B:
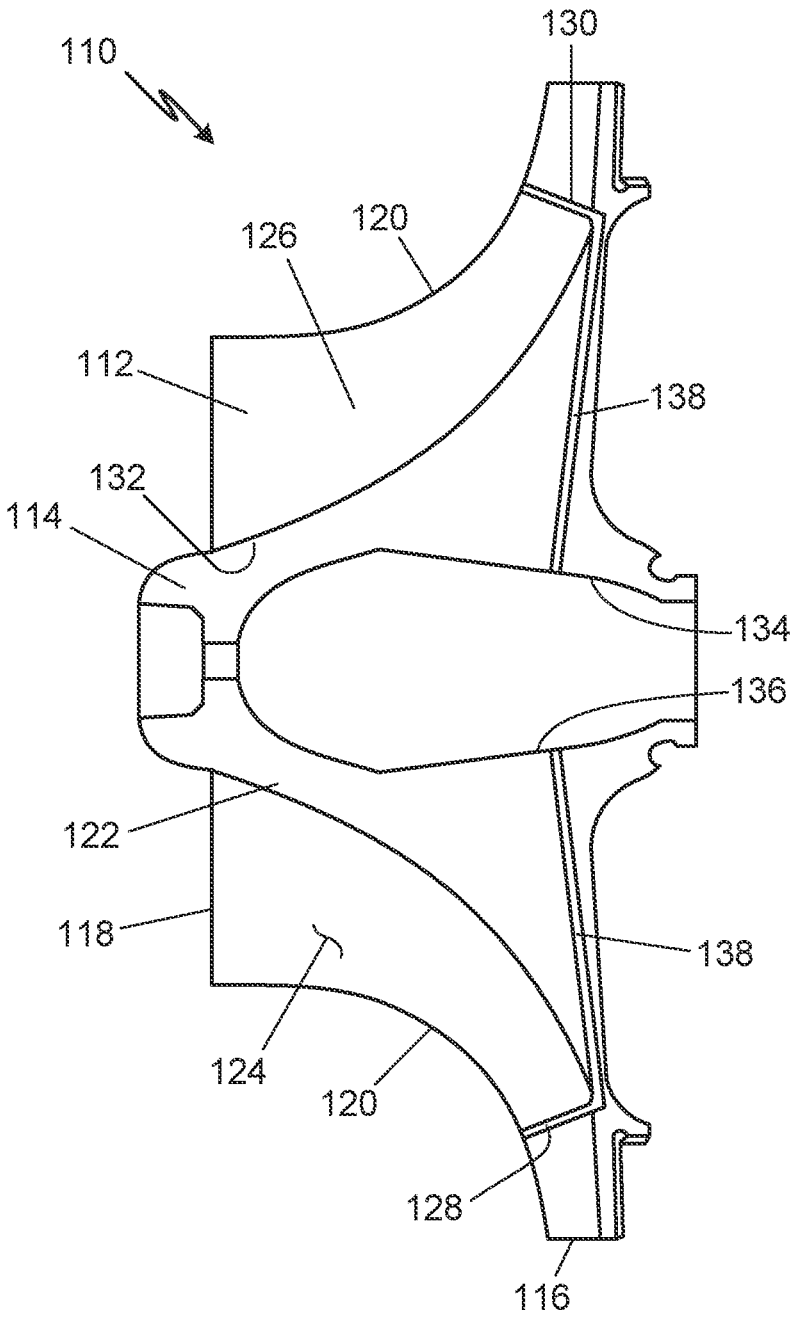
FIG. 2B is a cross-sectional view of the rotor shown in FIG. 2A.

FIG. 2A is a perspective view of rotor 110 with a first channel inlet 128 and a second channel inlet 130 in each blade 112. FIG. 2B is a cross-sectional view of rotor 110. FIGS. 2A-2B will be discussed together. Rotor 110 includes blades 112 and hub 114. Each blade 112 includes first edge 116, second edge 118, radially outer edge 120, radially inner edge 122, first side 124, second side 126 (shown in FIG. 2A), first channel inlet 128 (shown in FIG. 2B), and second channel inlet 130 (shown in FIG. 2A). Hub 114 includes radially outer side 132, radially inner side 134 (shown in FIG. 2B), outlets 136 (shown in FIG. 2B), and channels 138 (shown in FIG. 2B).

Rotor 110 is a turbine rotor, like first turbine rotor 52 or second turbine rotor 68 (shown in FIG. 1). Rotor 110 has blades 112 connected to hub 114. Each blade 112 includes first edge 116, second edge 118, radially outer edge 120, radially inner edge 122, first side 124, second side 126, first channel inlet 128 and second channel inlet 130. First edge 116 is a leading edge of blade 112. Second edge 118 is a trailing edge of blade 112. Radially outer edge 120 is radially away from a central axis of rotor 110. Radially inner edge 122 is opposite radially outer edge 120. Radially outer edge 120 and radially inner edge 122 extend between first edge 116 and second edge 118. First side 124 extends from first edge 116 to second edge 118 between radially outer edge 120 and radially inner edge 122. Second side 126 is opposite first side 124. First channel inlet 128 is in first side 124 of blade 112. First channel inlet 128 is near first edge 116. Second channel inlet 130 is opposite first channel inlet 128 in second side 126 of blade 112. First channel inlet 128 and second channel inlet can each have the following shapes: a single slot, multiple slots, a hole, connected holes, a porous or open cell type surface, or any combination thereof. First channel inlet 128 and second channel inlet 130 may be the same shape or have different shapes on rotor 110.

Hub 114 includes radially outer side 132, radially inner side 134, outlets 136, and channels 138. Radially outer side 132 is a side of hub 114 away from the central axis of rotor 110. Radially inner side 134 is opposite radially outer side 132. Radially outer side 132 of hub 114 connects to each blade 112 at each radially inner edge 122. Outlets 136 are in portions of radially inner side 134 of hub 114 opposite where each blade 112 connects to hub 114. Every blade 112 has an associated channel 138 within hub 114. Within each blade 112, a channel 138 fluidly connects a first channel inlet 128, a second channel inlet 130, and an outlet 136.

Working fluid flows through rotor 110 between blades 112. Working fluid could be air, nitrogen, hydrogen, refrigerant, or other gasses or liquids moving through a rotary machine. As the working fluid flows through rotor 110, rotor 110 spins and transfers energy from the working fluid to a tie rod, like tie rod 20 (shown in FIG. 1). The working fluid flowing through rotor 110 expands and cools. Portions of the working fluid approach rotor 110 with an inlet flow angle. Some portions of the working fluid approach first edges 116 of blade 112 at an inlet flow angle less than a minimum inlet angle. The minimum inlet angle is dependent on the mass flow rate of the working fluid, the rotational speed of rotor 110, and the thickness of blade 112. The minimum inlet angle is between 10 degrees and 15 degrees for thinner blades 112. Thicker blades 112 have a minimum inlet angle between 10 degrees and 20 degrees. When a mass of the working fluid approaches blade 112 at an inlet angle less than the minimum, the mass of the working fluid separates from the blade, creating a recirculation zone. First channel inlet 128 and second channel inlet 130 capture separated working fluid from the recirculation zone. Captured working fluid moves through channel 138. Channel 138 removes working fluid from first channel inlets 128 and second channel inlets 130. Removed working fluid exits channels 138 through outlets 136 in hub 114. Removed working fluid can be used for process purposes, like cooling bearings within the rotary machine.

Separated working fluid in a recirculation zone around blades 112 reduces efficiency and creates reliability issues within a rotary machine. Removing separated working fluid increases turbine performance, operating range, and shaft power in the rotary machine utilizing rotor 110. Placing first channel inlet 128 and second channel inlet 130 near first edge 116 reduces separated working fluid in rotor 110 because flow separation and resultant recirculating zones occur mainly near a leading edge of a rotor blade. Placing outlets 136 in radially inner side 134 of hub 114 allows for use of removed separated working fluid for technical processes in a rotary machine, like cooling bearings.

Figure 3A:
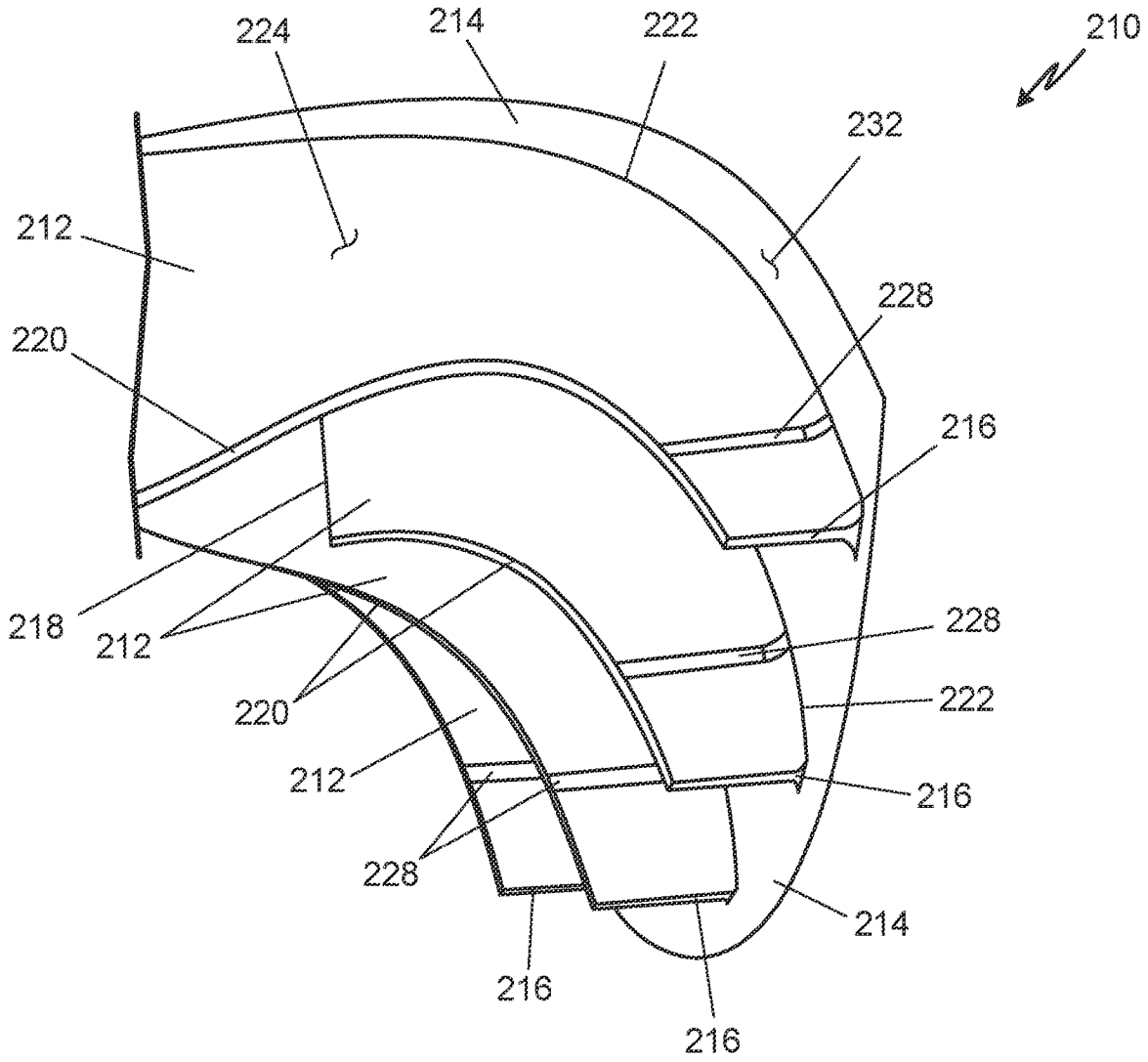
FIG. 3A is a perspective view of a section of a rotor with slot-shaped channel inlets.
Figure 3B:
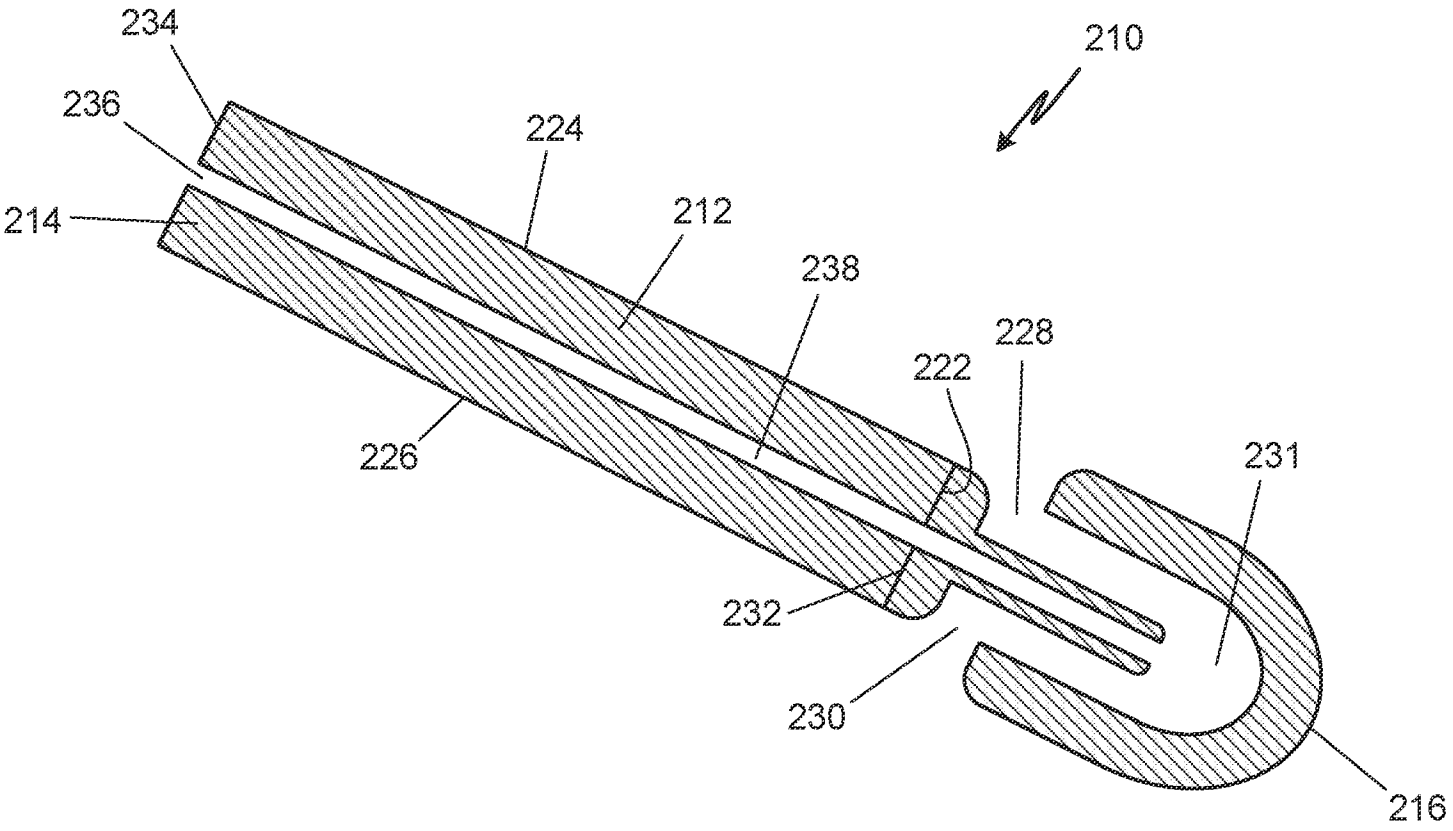
FIG. 3B is a cross-sectional view of the rotor blade with through-shaped channel inlets.

FIG. 3A is a perspective view of a section of rotor 210 with slot-shaped first channel inlets 228. FIG. 3B is a cross-sectional view of blade 212 taken through channel 238. FIG. 3B shows blade 212 with through-shaped first channel inlet 228 and through-shaped second channel inlet 230. FIGS. 3A-3B will be discussed together. Rotor 210 includes blades 212 and hub 214. Each blade 212 includes first edge 216, second edge 218 (shown in FIG. 3B), radially outer edge 220 (shown in FIG. 3A), radially inner edge 222, first side 224, and second side 226 (shown in FIG. 3B). Each blade 212 also includes first channel inlet 228, second channel inlet 230 (shown in FIG. 3B), and intermediate channel 231 (shown in FIG. 3B). Hub 214 includes radially outer side 232, radially inner side 234 (shown in FIG. 3B), outlets 236 (shown in FIG. 3B), and channels 238 (shown in FIG. 3B).

Rotor 210 is for a turbine such as first turbine section 16 or second turbine section 18 in air cycle machine 10 (shown in FIG. 1). Rotor 210 is configured similarly to rotor 110 (shown in FIGS. 2A-2B). Rotor 210 has blades 212 connected to hub 214. Each blade 212 includes first edge 216, second edge 218, radially outer edge 220, radially inner edge 222, first side 224, second side 226, first channel inlet 228 and second channel inlet 230. First edge 216 is a leading edge of blade 212. Second edge 218 is a trailing edge of blade 212 located away from first edge 216. Radially outer edge 220 is radially away from a center of rotor 210. Radially inner edge 222 is opposite radially outer edge 220. First side 224 extends between first edge 216 and second edge 218 from radially outer edge 220 to radially inner edge 222. Second side 226 is opposite first side 224. First channel inlet 228 is in first side 224 of blade 212. First channel inlet 228 is near first edge 216. Second channel inlet 230 is opposite first channel inlet 228 in second side 226 of blade 212. First channel inlet 228 and second channel inlet 230 extend from radially outer edge 220 to radially inner edge 222 of blade 212. First channel inlet 228 and second channel inlet 230 are long, narrow slots in first side 224 and second side 226, respectively. Alternatively, first channel inlet 228 and second channel inlet 230 could be multiple slots spaced along first side 224 and second side 226 of blades 212, respectively. Intermediate channel 231 is within blade 212. Intermediate channel 231 is U-shaped and generally following the shape of first edge 216. Intermediate channel fluidly connects first channel inlet 228 and second channel inlet 230.

Hub 214 includes radially outer side 232, radially inner side 234, outlets 236, and channels 238. Radially outer side 232 is a side of hub 214 away from a central axis of rotor 210. Radially inner side 234 is opposite radially outer side 232. Radially outer side 232 of hub 214 connects to each blade 212 at each of blades 212 radially inner edges 222. Outlets 236 are in portions of radially inner side 234 of hub 214 opposite where each blade 212 connects to hub 214. Every blade 212 has an associated channel 238 within hub 214. Within each blade 212, a channel 238 fluidly connects a first channel inlet 228 and a second channel inlet 230 with an outlet 236. In rotor 210, channels 238 fluidly connect to first channel inlets 228 and second channel inlets 230 via a connection with intermediate channels 231.

Rotor 210 rotates within a rotary machine, like air cycle machine 10 (shown in FIG. 1). Working fluid approaches rotor 210 near first edge 216 of blades 212. Working fluid includes air, nitrogen, hydrogen, refrigerant, or other gasses or liquids moving through the rotary machine utilizing rotor 210. As discussed in relation to FIGS. 2A-2B, some working fluid enters rotor 210 at an inlet angle to blade 212 less than a minimum inlet angle. This working fluid is forced around first edge 216 of blade 212 and separates from blade 212 and other working fluid creating a recirculating zone. Separated working fluid is captured by first channel inlet 228 and second channel inlet 230. Captured separated working fluid flows through intermediate channel 231 towards channel 238. Channel 238 removes captured separated working fluid to outlet 236 in hub 214. Removed separated working fluid is used for other processes in the rotary machine, like cooling bearings (as shown in FIG. 1).

As discussed in relation to FIGS. 2A-2B, removing separated working fluid in recirculation zones from rotor 210 increases the efficiency and operating range of a rotary machine utilizing rotor 210. Placing first channel inlet 228 and second channel inlet 230 near first edge 216, the leading edge of rotor 210, removes separated working fluid a section of blade 212 where recirculation zones are most likely to form. Shaping first channel inlet 228 and second channel inlet 230 as slots creates a large axial area that can remove separated working fluid where it forms along first sides 224 and second sides 226 of blades 212. Including intermediate channel 231 reduces the ability of suspended particles to enter channel 238.

Figure 4A:
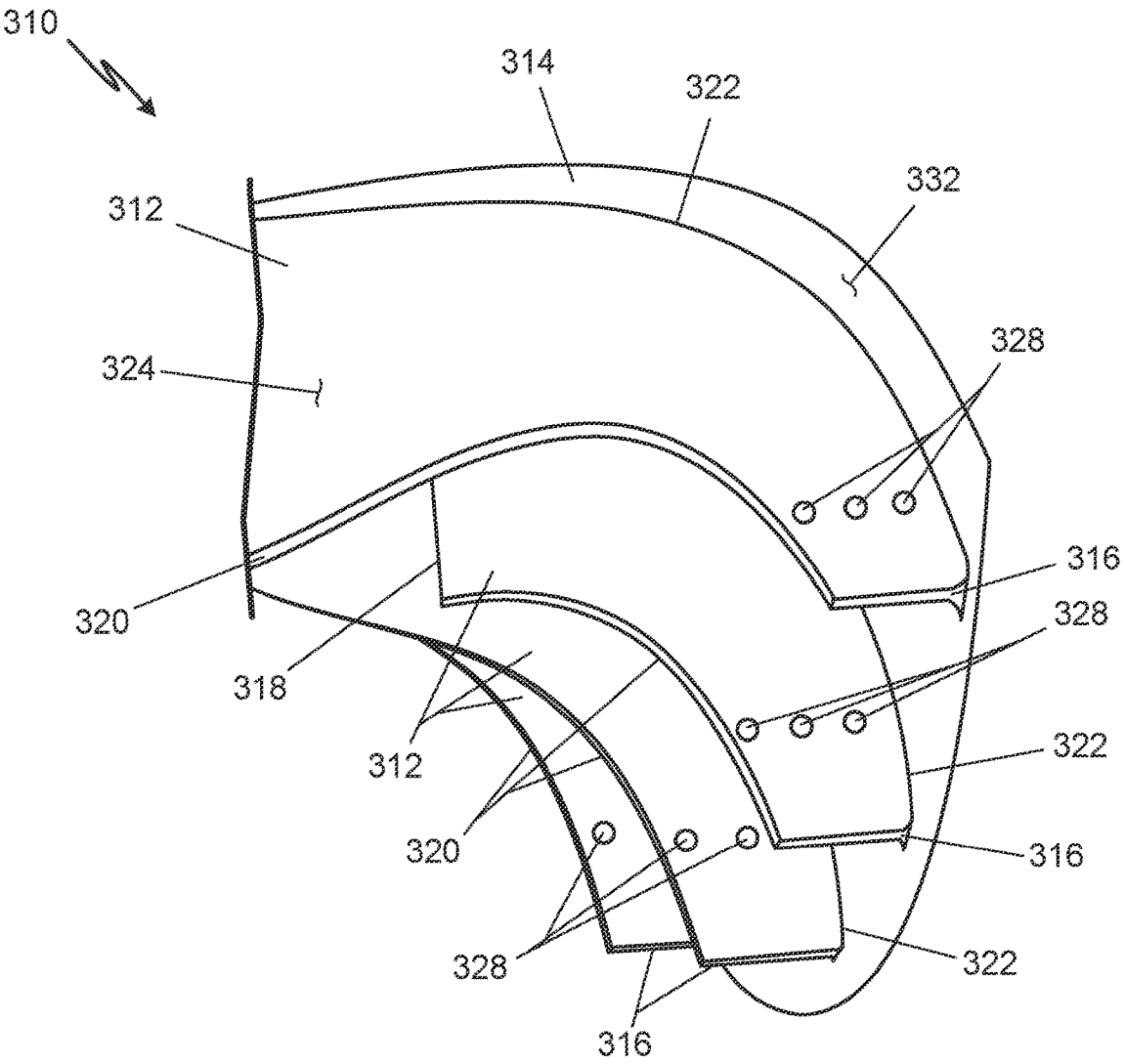
FIG. 4A is a perspective view of a section of a rotor with hole-shaped first channel inlets.
Figure 4B:
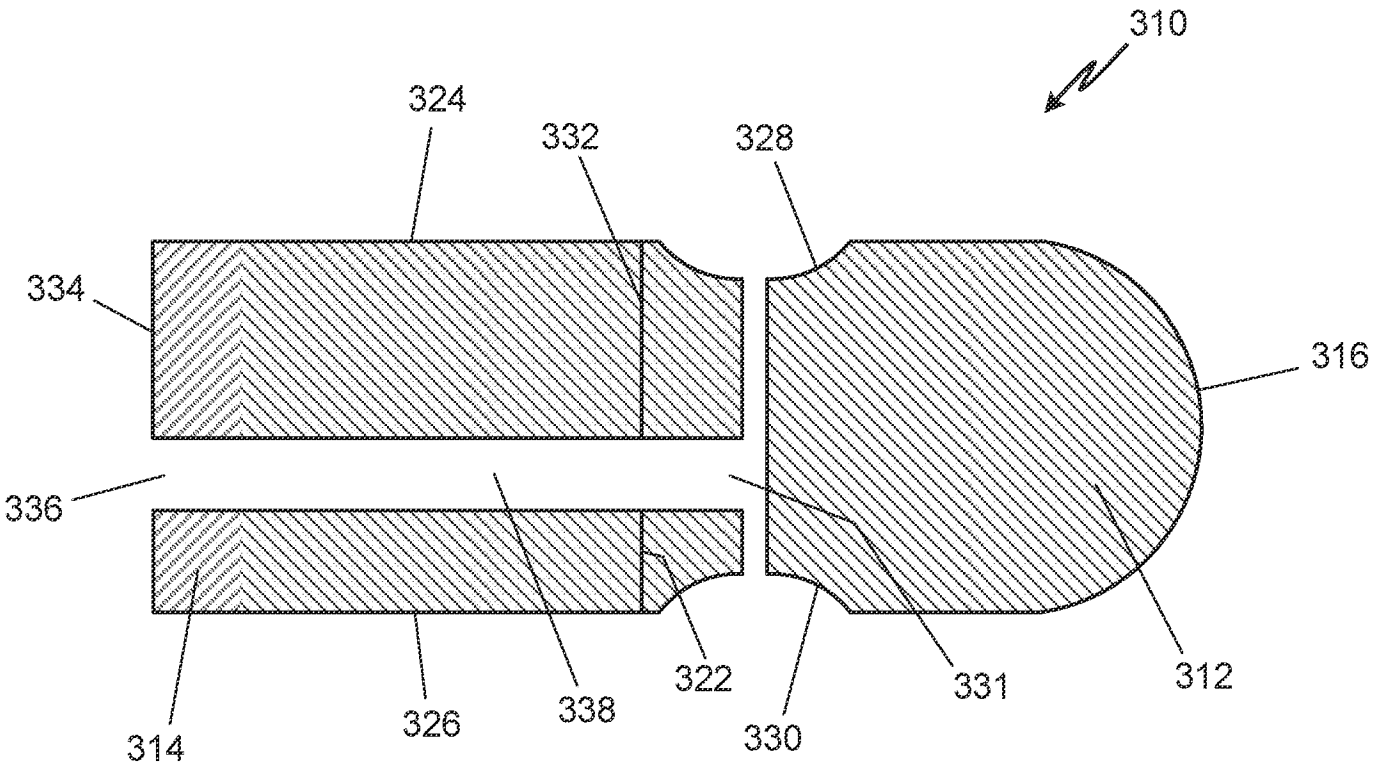
FIG. 4B is a cross-sectional view of the rotor blade with a hole-shaped first channel inlet and a hole-shaped second channel inlet.

FIG. 4A is a perspective view of a section of rotor 310 showing hole-shaped first channel inlets 328. FIG. 4B is a cross-sectional view of blade 312 taken through channel 338. FIG. 4B shows blade 312 with hole-shaped first channel inlet 328 and hole-shaped second channel inlet 330. FIGS. 4A-4B will be discussed together. Rotor 310 includes blades 312 and hub 314. Each blade 312 includes first edge 316, second edge 318 (shown in FIG. 4B), radially outer edge 320 (shown in FIG. 4A), radially inner edge 322, first side 324, and second side 326 (shown in FIG. 4B). Each blade 312 also includes first channel inlet 328, second channel inlet 330 (shown in FIG. 4B), and intermediate channel 331 (shown in FIG. 4B). Hub 314 includes radially outer side 332, radially inner side 334 (shown in FIG. 4B), outlets 336 (shown in FIG. 4B), and channels 338 (shown in FIG. 4B).

Rotor 310 is for a turbine like first turbine section 16 or second turbine section 18 in air cycle machine 10 (shown in FIG. 1). Rotor 310 has blades 312 connected to hub 314. Blades 312 are generally configured like blades 212 in FIGS. 3A-3B. Each blade 312 includes first edge 316, second edge 318, radially outer edge 320, radially inner edge 322, first side 324, second side 326, first channel inlet 328 and second channel inlet 330. First edge 316 is a leading edge of rotor 310. Second edge 318 is a trailing edge of blade 312 located away from first edge 316. Radially outer edge 320 is radially away from a center of rotor 310. Radially inner edge 322 is opposite radially outer edge 320. First side 324 extends between first edge 316 and second edge 318 and radially outer edge 320 and radially inner edge 322. Second side 326 is opposite first side 324.

First channel inlet 328 is in first side 324 of blade 312 near first edge 316. First channel inlet 328 is a first row of holes. Second channel inlet 330 is opposite first channel inlet 328 in second side 326 of blade 312. Second channel inlet 330 is a second row of holes. FIG. 4A shows three holes in each row of holes making up first channel inlets 328. However, other quantities of holes are also possible. First channel inlet 328 and second channel inlet 330 could each alternatively be multiple rows of holes spaced along first side 324 and second side 326 of blade 312, respectively. The holes could also be spaced in irregular patterns along first side 324 and second side 326 of blade 312. The holes can also be positioned and aimed to best capture separated or recirculating working fluid near blade 312. First channel inlet 328 and second channel inlet 330 connect to intermediate channel 331. Intermediate channel 331 connects to first channel inlet 328 and second channel inlet 330 at right angles. However, intermediate channel 331 can be designed to connect to first channel inlet 328 and second channel inlet 330 at different angles to best capture separated working fluid.

Hub 314 includes radially outer side 332, radially inner side 334, outlets 236, and channels 238. Radially outer side 332 is a side of hub 314 away from a central axis of rotor 310. Radially inner side 334 opposite radially outer side 332. Radially outer side 332 of hub 314 connects to each blade 312 at each radially inner edge 322. Outlets 336 are in portions of radially inner side 334 of hub 314 opposite where blades 212 connects to hub 214. Every blade 312 has an associated channel 338 within hub 314. Within each blade 312, a channel 338 fluidly connects first channel inlet 328 and a second channel inlet 330 with an outlet 336. In rotor 310, channels 338 fluidly connect to first inlets 328 and second channel inlets 330 via a connection with intermediate channels 331.

Rotor 310 operates like rotor 110 (shown in FIG. 2A-2B) and rotor 210 (shown in FIGS. 3A-3B). Rotor 310 rotates within a turbine. Working fluid approaches rotor 310 near first edge 316 of blades 312. Working fluid includes air, nitrogen, hydrogen, refrigerant, or other gasses or liquids moving through a rotary machine utilizing rotor 310. As discussed in relation to FIGS. 2A-2B, some working fluid enters rotor 310 at an inlet angle to blades 312 less than a minimum inlet angle. This working fluid is forced around first edge 316 of blade 312 and separates from other working fluid, becoming a recirculation zone. Separated working fluid is captured by first channel inlet 328 and second channel inlet 330. Captured separated working fluid flows through intermediate channel 331 towards channel 338. Captured separated working fluid is then removed through channel 338 to outlet 336 in hub 314. Removed separated working fluid is used for other processes in the rotary machine, like cooling bearings (as shown in FIG. 1).

Removing separated working fluid through first channel inlet 328 and second channel inlet 330 increases the efficiency of a rotary machine utilizing rotor 310, as discussed in relation to FIGS. 2A-3B. Shaping first channel 328 inlet and second channel inlet 330 as holes increases the flexibility of designing rotor 310. Holes making up first channel inlet 328 and second channel inlet 330 can be placed where most separated working fluid can be intercepted. Holes can also be angled to better intercept separated working fluid by changing the angle of intermediate channel 331 in relation to first channel inlet 338 and second channel inlet 330.

Figure 5A:
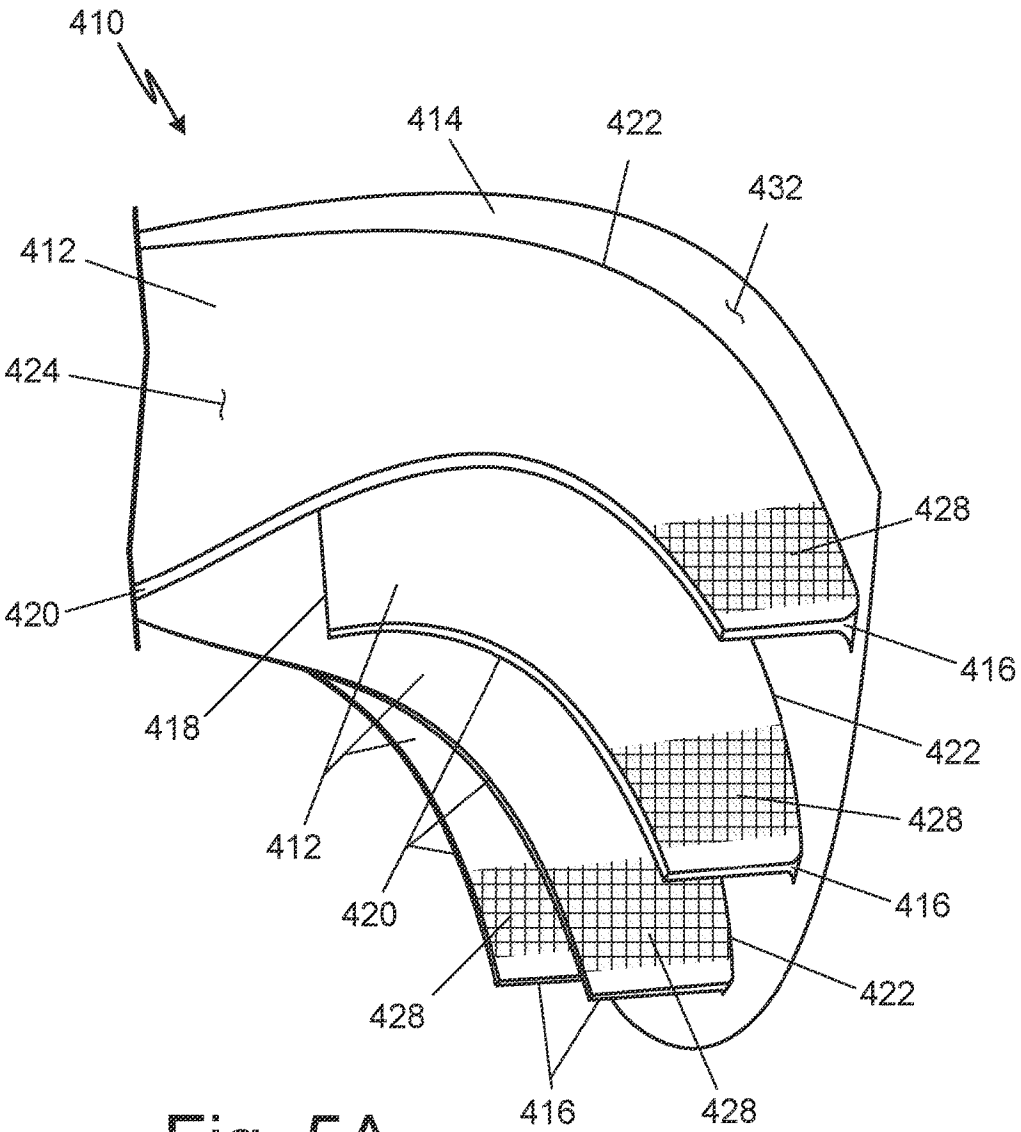
FIG. 5A is a perspective view of a section of a rotor with porous first channel inlets.
Figure 5B:
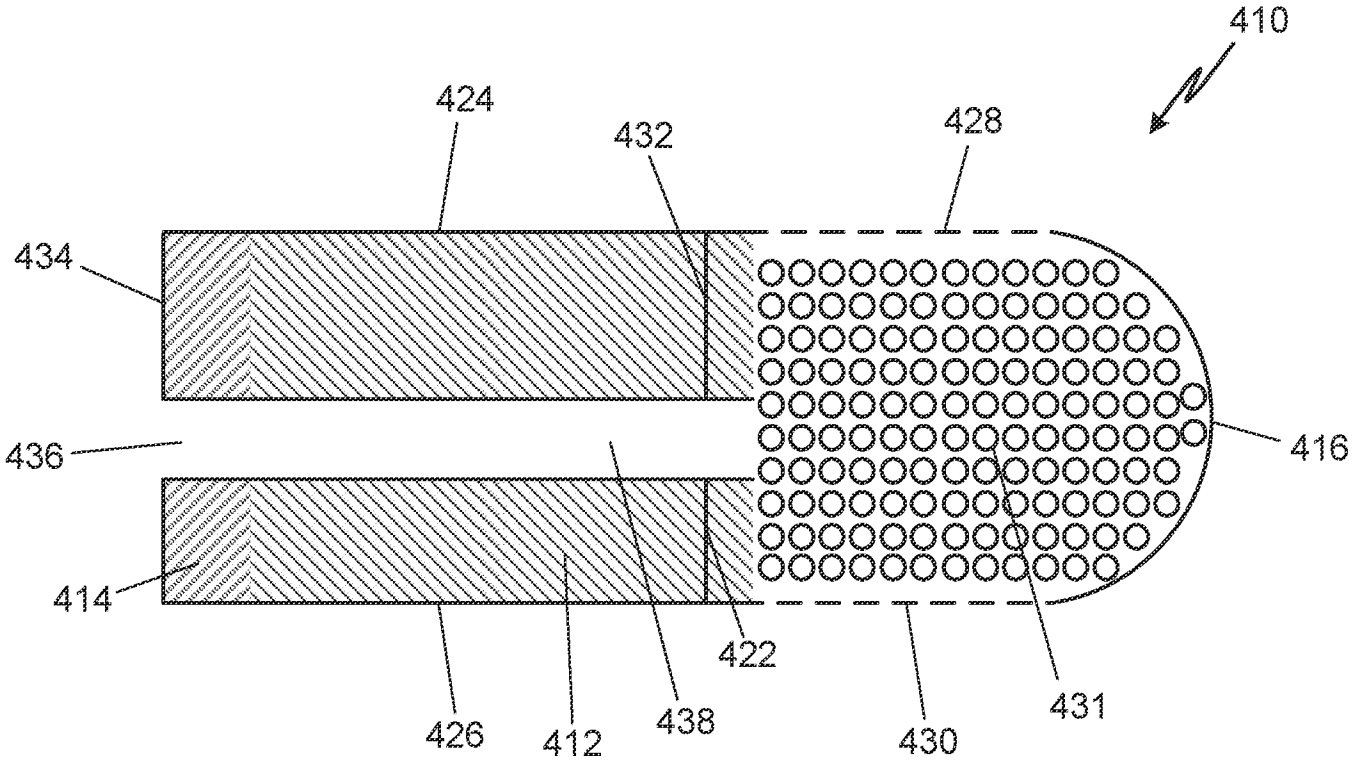
FIG. 5B is a cross-sectional view of the rotor blade with a porous first channel inlet and a porous second channel inlet.

FIG. 5A is a perspective view of a section of rotor 410 with porous first channel inlets 428. FIG. 5B is a cross-sectional view of blade 412 taken through channel 438. FIG. 5B shows blade 412 with porous first channel inlet 428 and porous second channel inlet 430. Rotor 410 includes blades 412 and hub 414. Each blade 412 includes first edge 416, second edge 418 (shown in FIG. 5B), radially outer edge 420 (shown in FIG. 5B), radially inner edge 422, first side 424, and second side 426 (shown in FIG. 5B). Each blade 412 also includes first channel inlet 428, second channel inlet 430 (shown in FIG. 5B), and interior porous portion 431 (shown in FIG. 5B). Hub 414 includes radially outer side 432, radially inner side 434 (shown in FIG. 5B), and outlet 436 (shown in FIG. 5B). Rotor 410 also includes channel 438 (shown in FIG. 5B).

Rotor 410 is for a turbine such as first turbine section 16 or second turbine section 18 in air cycle machine 10 (shown in FIG. 1). Rotor 410 is generally configured like rotor 110, rotor 210 and rotor 310. Rotor 410 has blades 412 connected to hub 414. Each blade 412 includes first edge 416, second edge 418, radially outer edge 420, radially inner edge 422, first side 424, second side 426, first channel inlet 428 and second channel inlet 430. First edge 416 is a leading edge of rotor 410. Second edge 418 is a trailing edge of blade 412 located away from first edge 416. Radially outer edge 420 is radially away from a center of rotor 410. Radially inner edge 422 is opposite radially outer edge 420. First side 424 extends between first edge 416 and second edge 418 and radially outer edge 420 and radially inner edge 422. Second side 426 is opposite first side 424. First channel inlet 428 is in first side 424 of blade 412.

First channel inlet 428 is near first edge 416. Second channel inlet 430 is opposite first channel inlet 428 in second side 426 of blade 412. First channel inlet 428 and second channel inlet 430 are porous portions in first side 424 and second side 426 of blade 412, respectively. First channel inlet 428 and second channel inlet 430 extend from radially outer edge 420 to radially inner edge 422 of blade 412. Interior porous portion 431 fluidly connects first channel inlet 428 and second channel inlet 430.

Hub 414 includes radially outer side 432, radially inner side 434, outlets 436, and channels 438. Radially outer side 442 is a side of hub 414 located away from a central axis of rotor 410. Radially inner side 434 is opposite radially outer side 432. Radially outer side 432 of hub 414 connects to each blade 412 at radially inner edge 422 of each blade 412. Outlets 436 are in portions of radially inner side 434 of hub 414 opposite where each blade 412 connects to hub 414. Every blade 412 has an associated channel 438 within hub 414. Within each blade 412, a channel 438 fluidly connects a first channel inlet 428 and a second channel inlet 430 with an outlet 436. In rotor 410, channels 438 fluidly connect to first channel inlets 428 and second channel inlets 430 via a connection with interior porous portion 431. Alternatively, channels 438 can be eliminated if blade 412 is porous throughout to openings 436.

Rotor 410 rotates within a rotary machine, like first turbine section 16 and second turbine section 18 in air cycle machine 10 (shown in FIG. 1). Working fluid approaches rotor 410 near first edges 416 of blades 412. Working fluid includes air, nitrogen, hydrogen, refrigerant, or other gasses or liquids moving through a rotary machine utilizing rotor 410. As discussed in relation to FIGS. 2A-4B, some working fluid enters rotor 410 at an inlet angle to blade 412 less than a minimum inlet angle. This working fluid is forced around first edge 416 of blade 412 and separates from other working fluid, creating a recirculation zone. Separated working fluid is captured by first channel inlet 428 and second channel inlet 430. Captured separated working fluid flows through interior porous portion 431 towards channel 438. Captured separated working fluid is then removed through channel 438 to outlet 436 in hub 414. Removed separated working fluid is used for other processes in the rotary machine, like cooling bearings (as shown in FIG. 1).

Removing separated and recirculating working fluid through first channel inlet 428 and second channel inlet 430 increase the overall efficiency of a rotary machine utilizing rotor 410, as discussed in relation to FIGS. 2A-4B. Shaping first channel inlet 428 and second channel inlet 430 as porous portions in first side 424 and second side 426 of blade 412, respectively, creates many angles separated working fluid can enter blade 412. Further, shaping first channel inlet 428 and second channel inlet 430 as porous portions stretching from radially outer edge 420 to radially inner edge 422 increases the area of blade 412 that can intercept separated working fluid. Porous openings also reduce the ability of suspended particles to enter blade 412.

Discussion of Possible Embodiments

The following are non-exclusive descriptions of possible embodiments of the present invention.

A rotor includes a blade, a hub connected to a radially inner edge of the blade, an outlet, and a channel. The blade includes a first side between a leading edge and a trailing edge and a first channel inlet in the first side of the blade. The outlet is in a radially inner surface of the hub. The channel is between the first channel inlet and the outlet.

The rotor of the preceding paragraph can optionally include, additionally and/or alternatively, any one or more of the following features, configurations and/or additional components:

A further embodiment of the foregoing rotor wherein the blade further includes a second side of the blade opposite the first side and a second channel inlet in the second side of the blade. The channel fluidly connects the second channel inlet to the outlet.

A further embodiment of any of the foregoing rotors wherein the blade further includes an intermediate channel fluidly connecting the first channel inlet and the second channel inlet to the channel.

A further embodiment of any of the foregoing rotors wherein the first channel inlet is a slot and wherein the second channel inlet is a slot.

A further embodiment of any of the foregoing rotors wherein the first channel inlet is a first row of holes, and wherein the second channel inlet is a second row of holes.

A further embodiment of any of the foregoing rotors wherein the first channel inlet is a porous section of the first side of the blade.

A further embodiment of any of the foregoing rotors wherein the blade further includes a second side of the blade opposite the first side, a second channel inlet in the second side of the blade, and an interior porous portion near the leading edge of the blade. The channel fluidly connects the second channel inlet to the outlet. The second channel inlet is a porous section of the second side of the blade. The interior porous portion fluidly connects the first channel inlet and the second channel inlet to the channel.

A rotor includes a hub, a plurality of blades, outlets, and channels. Each of the blades include a radially inner edge and a first channel inlet. The radially inner edges are connected to the hub. The first channel inlets are in a first side of each blade and are positioned to capture working fluid recirculating near leading edges of the blades. The outlets are in a radially inner surface of the hub opposite where each blade connects to the hub. The channels are within the hub and remove the captured working fluid from the first channel inlets to the outlets.

The rotor of the preceding paragraph can optionally include, additionally and/or alternatively, any one or more of the following features, configurations and/or additional components:

A further embodiment of the foregoing rotor further including a primary flow path along a radially outer surface of the hub and a secondary flow path for capturing separated working fluid recirculating near the leading edges of the blades. The secondary flow path removes the captured working fluid from the primary flow path. The first channel inlets capture the separated recirculating working fluid. The channels remove the captured working fluid through the outlets.

A further embodiment of any of the foregoing rotors, wherein the secondary flow path uses the captured and removed working fluid for cooling a bearing supporting the rotor.

A further embodiment of any of the foregoing rotors, wherein each blade further includes a second side of the blade opposite the first side and a second channel inlet in the second side of the blade. The channel fluidly connects the second channel inlet to the outlet.

A further embodiment of any of the foregoing rotors, wherein the first channel inlets are slots, and wherein the second channel inlets are slots.

A further embodiment of any of the foregoing rotors, wherein the first channel inlets are a first series of holes, and wherein the second channel inlets are a second series of holes.

A further embodiment of any of the foregoing rotors, wherein the first channel inlets are porous sections of the first sides of the blades and the second channel inlets are porous sections of the second sides of the blades. A section of the interior of the blade is porous.

A rotary machine includes a first inlet, a first outlet, a first duct, a first rotor, a first bearing, and a cooling flow path. The first duct extends from the first inlet to the first outlet. The first rotor is in the duct. The first rotor includes a blade, a hub connected to a radially inner edge of the blade, a channel outlet, and a channel. The blade further includes a first side between a leading edge and a trailing edge and a first channel inlet in the first side of the blade. The channel outlet is in a radially inner surface of the hub. The first channel is between the first channel inlet and the channel outlet. The first bearing supports the rotor. The cooling flow path begins at the first channel inlet and provides working fluid to the first bearing.

The rotary machine of the preceding paragraph can optionally include, additionally and/or alternatively, any one or more of the following features, configurations and/or additional components:

A further embodiment of the foregoing rotary machine, and further including a second inlet, a second outlet, a second duct, a second rotor, a tie shaft, a second bearing, and a third bearing. The second duct extends from the second inlet to the second outlet. The second rotor is in the second duct. The tie shaft mechanically connects the first rotor and the second rotor. The second bearing supports the second rotor. The third bearing supports the tie shaft. The cooling flow path is between the first channel inlet in the first rotor and the second inlet. The cooling flow path provides cooling fluid to the first bearing, the second bearing, and the third bearing.

A further embodiment of any of the foregoing rotary machines, wherein the blade further includes a second side of the blade opposite the first side and a second channel inlet in the second side of the blade. The second channel inlet fluidly connects to the channel.

A further embodiment of any of the foregoing rotary machines, wherein the first channel inlet is a slot, and wherein the second channel inlet is a slot.

A further embodiment of any of the foregoing rotary machines, wherein the first channel inlet is a row of holes, and wherein the second channel inlet is a row of holes.

A further embodiment of any of the foregoing rotary machines, wherein the first channel inlet is a porous portion of the first side of the blade. The blade further includes a second side of the blade opposite the first side; a second channel inlet in the second side, wherein the second channel inlet is a porous portion of the second side of the blade; and an interior porous portion near the leading edge of the blade and fluidly connecting the first channel inlet and the channel.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A rotor comprising:

a blade comprising:

a first side between a leading edge and a trailing edge;

a second side between the leading edge and the trailing edge;

a first channel inlet in the first side of the blade, wherein the first channel inlet is a porous section of the first side of the blade;

a second channel inlet in the second side of the blade, wherein the second channel inlet is a porous section of the second side of the blade; and an interior porous portion with an open cell type structure adjacent to the leading edge of the blade and fluidly connected to each of the first channel inlet and the second channel inlet;

a hub connected to a radially inner edge of the blade;

an outlet in a radially inner surface of the hub; and a channel extending from the interior porous portion, through the hub, and towards the outlet.

2. A rotor comprising:

a hub;

a plurality of blades, each blade comprising:

a radially inner edge connected to the hub;

a leading edge of the blade extending from the radially inner edge;

a first channel inlet in a first side of the blade, the first channel inlet positioned adjacent to the leading edge of the blade;

a second channel inlet in a second side of the blade, the second channel inlet positioned adjacent to the leading edge of the blade; and an intermediate channel connected to each of the first channel inlet and the second channel inlet, wherein the intermediate channel follows a U-shaped path around an inside of the leading edge of the blade;

a plurality of outlets in a radially inner surface of the hub opposite to where each blade connects to the hub; and a plurality of channels within the hub, each channel extending from the intermediate channel of a respective blade, through the hub, and towards a respective outlet of the plurality of outlets.

3. The rotor of claim 2, further comprising:

a primary flow path extending along a radially outer surface of the hub; and a secondary flow path including each of the first channel inlet and the second channel, the intermediate channel, a respective channel of the plurality of channels, and the respective outlet of the plurality of outlets.

4. The rotor of claim 3, wherein the secondary flow path provides a working fluid to cool a bearing supporting the rotor.

5. The rotor of claim 2, wherein the first channel inlet comprises at least one first slot, and wherein the second channel inlet comprises at least one second slot.

6. The rotor of claim 2, wherein the first channel inlet comprises a first series of holes, and wherein the second channel inlet comprises second series of holes.

7. A rotary machine comprising:

a first rotary machine inlet;

a first rotary machine outlet;

a first duct extending from the first rotary machine inlet to the first rotary machine outlet;

a first rotor in the first duct, the first rotor comprising:

a hub;

a plurality of blades, each blade comprising:

a radially inner edge connected to the hub;

a leading edge of the blade extending from the radially inner edge;

a first channel inlet in a first side of the blade, the first channel inlet positioned adjacent to the leading edge of the blade;

a second channel inlet in a second side of the blade, the second channel inlet positioned adjacent to the leading edge of the blade; and an intermediate channel connected to each of the first channel inlet and the second channel inlet, wherein the intermediate channel follows a U-shaped path around an inside of the leading edge of the blade;

a plurality of channel outlets in a radially inner surface of the hub; and a plurality of channels within the hub, each channel extending from the intermediate channel of a respective blade, through the hub, and towards a respective channel outlet of the plurality of channel outlets;

a first bearing supporting the first rotor; and a cooling fluid flow path including each of the first channel inlet and the second channel inlet, the intermediate channel, a respective channel of the plurality of channels, and a respective channel outlet of the plurality of channel outlets, wherein the cooling fluid flow path provides a working fluid to the first bearing.

8. The rotary machine of claim 7, further comprising:

a second rotary machine inlet;

a second rotary machine outlet;

a second duct extending from the second rotary machine inlet to the second rotary machine outlet;

a second rotor in the second duct;

a tie shaft mechanically connecting the first rotor and the second rotor;

a second bearing supporting the second rotor; and a third bearing supporting the tie shaft;

wherein the cooling fluid flow path provides the working fluid to the first bearing, the second bearing, and the third bearing.

9. The rotary machine of claim 7, wherein the first channel inlet is a first slot, and wherein the second channel inlet is a second slot.

10. The rotary machine of claim 7, wherein the first channel inlet is a first row of holes, and wherein the second channel inlet is a second row of holes.

* * * * *